United States Patent [19]

Radwanski et al.

[11] Patent Number: 4,650,127

[45] Date of Patent: Mar. 17, 1987

[54] METHOD AND APPARATUS FOR FIBERIZING FIBROUS SHEETS

[75] Inventors: Fred R. Radwanski; Elizabeth A. Wolfson, both of Winnebago County; James L. Post, Outagamie County, all of Wis.

[73] Assignee: Kimberly-Clark Corporation, Neenah, Wis.

[21] Appl. No.: 696,948

[22] Filed: Jan. 31, 1985

[51] Int. Cl.[4] ..... B02C 18/16; B02C 19/12

[52] U.S. Cl. ..... 241/28; 241/101 D; 241/222; 241/294

[58] Field of Search ..... 241/27, 28, 222, 223, 241/242, 243, 293, 294, 189 R, 194, 195, 101 D; 425/82.1; 19/306, 83

[56] References Cited

U.S. PATENT DOCUMENTS

| | | | |
|---|---|---|---|
| 426,217 | 4/1890 | Russell | 241/222 |
| 526,043 | 9/1894 | Merrill | 241/242 |
| 3,519,211 | 5/1967 | Sakulich et al. . | |
| 3,637,146 | 10/1969 | Banks . | |
| 3,750,962 | 9/1971 | Morgan, Jr. . | |
| 3,824,652 | 7/1974 | Buell | 425/82.1 |
| 3,825,194 | 9/1971 | Buell . | |

*Primary Examiner*—Mark Rosenbaum

*Attorney, Agent, or Firm*—P. A. Leipold; D. L. Traut; J. J. Duggan

[57] ABSTRACT

A fiberizer for disintegrating fibrous sheets and a method of fiberizing using a rotor having peripheral teeth arranged within bands which extend transversely around the rotor axis is disclosed. The tooth pattern in each band is circumferentially extending and shaped approximately in a sinusoidal wave on the rotor periphery extending in the direction of rotation, and providing a substantially sinusoidal distribution of impacts against a sheet fed to an anvil in the form of simple harmonic motion along a cross direction impact line adjacent the anvil and thus transversing impacts within adjacent strips of the sheet corresponding to the bands. Individual points along the width of the fibrous sheet are periodically impulsively loaded by the impacts when they are at a period of highest response, i.e., when the initial stress level has been increased to the highest optimal stress without causing fiber damage, and producing mechanical disturbances within the sheets which cause vibrations and break interfiber bonds so as to precondition the sheet as it is fed to the anvil.

29 Claims, 14 Drawing Figures

TOOTH ARRANGEMENT AND HIT FREQUENCY PATTERNS

CET TRIALS (APPROXIMATE SHEET IMPACT LENGTH, 4 IMPACTS/8 IMPACTS/MD PLANE, IN.)

SHEET IMPACT LENGTH AFFECT ON FIBERIZATION

TOOTH WIDTH AFFECT ON FIBERIZATION

SHEET IMPACT AREA AFFECT ON FIBERIZATION

TOOTH/ANVIL GAP AFFECT ON FIBERIZATION

TOOTH SPACING WITHIN A ROW AFFECT ON FIBERIZATION

METHOD AND APPARATUS FOR FIBERIZING FIBROUS SHEETS

TECHNICAL FIELD

This invention relates to the production of absorbent airfelt pads of individual fibers from fibrous sheets and, more particularly, to an improved method for disintegrating fibrous sheets into individual fibers and an improved fiberizer.

BACKGROUND ART

Fiberizers, also called hammermills or disintegrators, are employed in the production of products requiring an absorbent fibrous airfelt pad. Using fiberizers, sheets of fibrous material are disintegrated into individual fibers which are transmitted to a foraminous conveyor on which an airfelt is formed. Fiberizers employ impact elements such as hammers or teeth carried on the periphery of a cylindrical rotor. To disintegrate the fibrous sheets, they are fed through infeed slots which lead to an anvil and into contact with the impact elements on the periphery of the rotor. The impact elements have faces positioned to hit the sheets, the direct impact causing individual fibers to be separated and the sheets to be fiberized. This separation of fibers by direct impact is called primary fiberization and is to be contrasted with secondary fiberization, which occurs when clumps of fibers torn from the fibrous sheets are rubbed by the rotor against screens or casing or casing protuberances which normally surround the rotor and are separated into individual fibers.

Heretofore, various patterns have been proposed for impact elements on the periphery of disintegrator rotors. In Sakulich et al, U.S. Pat. No. 3,519,211, teeth are arranged such that successive rows are offset and the time between successive impacts by the tips of the teeth is a minimum of about 0.4 milliseconds.

According to Buell, U.S. Pat. No. 3,824,652, it is preferred to have teeth randomly disposed on the rotor periphery and a reasonable approximation thereof is said to consist of multiple sets of teeth in helical patterns with helical angles of 10 degrees to 35 degrees and with teeth equidistant in all directions. One disclosed arrangement has a second adjacent set of teeth bearing a helical pattern which is an approximate mirror image of the pattern in the first portion, offset slightly, and in which the teeth are maintained about five widths apart in order to avoid poor fiberization due to one or more teeth being too close together.

Banks, U.S. Pat. No. 3,637,146, discloses impact elements having a beveled face.

DISCLOSURE OF INVENTION

The principal object of this invention is to provide a fiberizing method and apparatus for increasing fiberization levels at higher throughput rates while minimizing fiber damage.

To achieve this objective, the fiberization method and apparatus according to this invention entails feeding a fibrous sheet to an anvil adjacent a fiberizer rotor having teeth arranged on the periphery of the rotor in circumferential bands transverse to the rotor axis, the teeth within each band being arranged in a repeating, periodic wave pattern that produces hits against the sheet distributed in simple harmonic motion along a cross direction impact line adjacent the anvil in each machine direction strip of the sheet corresponding to each band.

It has been observed that, with teeth so arranged in such a pattern, adjacent areas of the sheet are constantly being stretched, the leading edge of the sheet is impulsively loaded and the loading is periodically regulated by the impacts of the teeth to generate machine direction and cross direction mechanical disturbances or stress waves traveling from the node of impact, which cause the sheet to flutter or vibrate within the infeed slot and produce a preconditioning of the sheet by breaking a portion of the interfiber bonds. Upon impact against the anvil, the leading edge of the fibrous sheet is caused to rebound and the internal stresses together with the preconditioning cause an "explosion" debonding into individual fibers, the impacts serving to continuously transfer energy to the sheet and regulate the stress waves that cause the preconditioning and post-impact explosion of the sheet into individual fibers.

BRIEF DESCRIPTION OF DRAWINGS

Further objects will appear from the following description taken in connection with the accompanying drawings, in which.

BEST MODE FOR CARRYING OUT THE INVENTION

While the invention will be described in connection with preferred embodiments, it is intended the invention not be limited thereto but only as defined in the appended claims.

Figure 1:
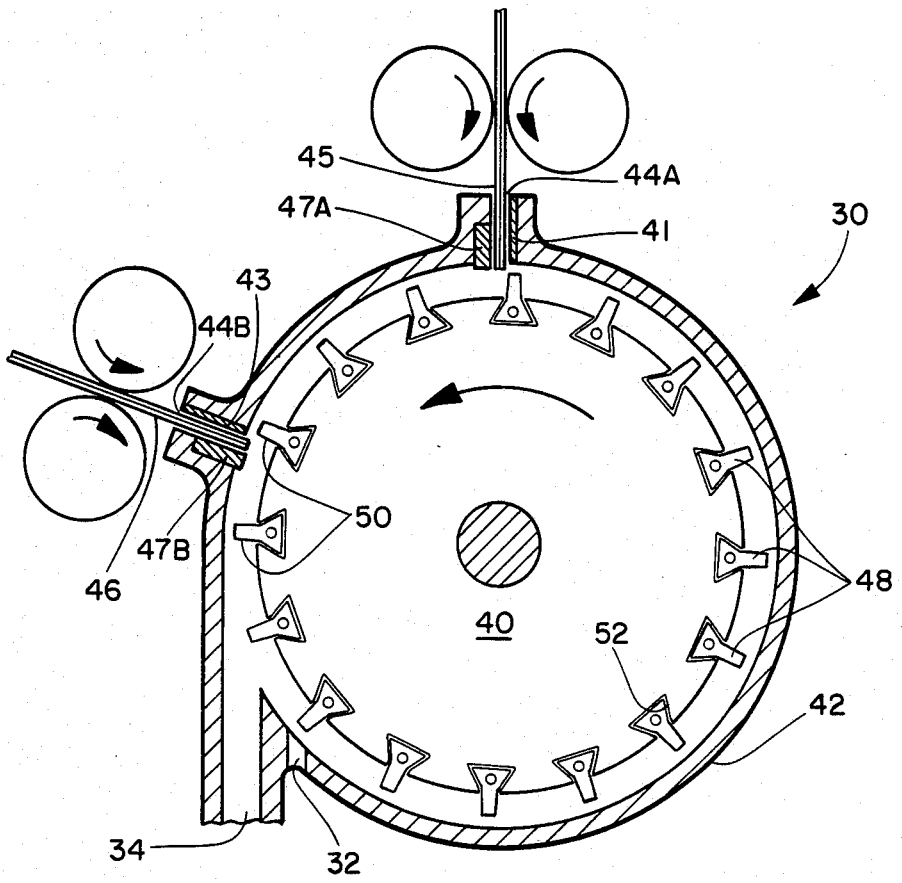
FIG. 1 is a cross sectional view of a fiberizer constructed according to this invention.
Figure 2:
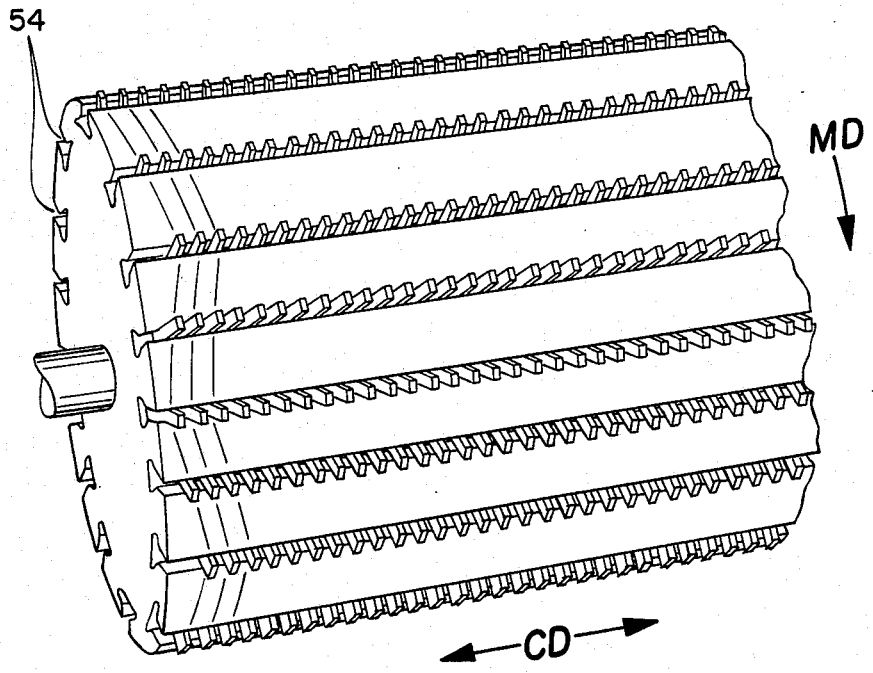
FIG. 2 is a fragmentary perspective view of the fiberizer rotor of FIG. 1 to illustrate the arrangement of rotor teeth.

CET Fiberizer Rotors:

Turning to the drawings, in FIGS. 1 and 2 a fiberizer 30 for disintegrating fibrous sheets is shown having a cylindrical rotor 40 rotatable about its cylindrical axis and a casing 42 for the rotor having casing air inlet 32, discharge exit 34 and a plurality of infeed slots 44A, 44B, herein shown as two slots approximately 70 degrees apart, for receiving a fibrous sheet 45, 46, or a plurality of superposed sheets fed by means of rollers edge first to anvils 47A, 47B adjacent the periphery of the rotor 40. Teeth 48 on the periphery of the rotor 40 each have a beveled face 50 positioned to pass anvil 47A and 47B pulp and support plates 41 and 43 with defined gaps and strike the sheets fed through the infeed slots 45, 46, along an impact line adjacent each anvil and extending in the cross direction of the sheets. When the fiberizer of the invention is used as a primary fiberizer the discharge opening 34 would not contain a screen. If used for secondary fiberization a screen could be placed over the opening 34 which opening would be larger in size to achieve more screen surface area and/or to distribute the discharge of the fibers. In such a case the design of the rotor would be hollowed or concave between axial rows of teeth so as to increase air flow in the fiberizer.

While the fibrous sheets supplied to the fiberizer may be composed exclusively of natural cellulose fibers, the fiberizer of this invention may also be used for disintegrating fibrous sheets containing other fibers exclusively or in part, such as fibrillated polyolefin fibers sold commercially in the form of pulps under the trademark PULPEX. By fibrous sheets, therefore, is meant fibrous sheets containing natural cellulose and/or synthetic fibers.

Figure 5:
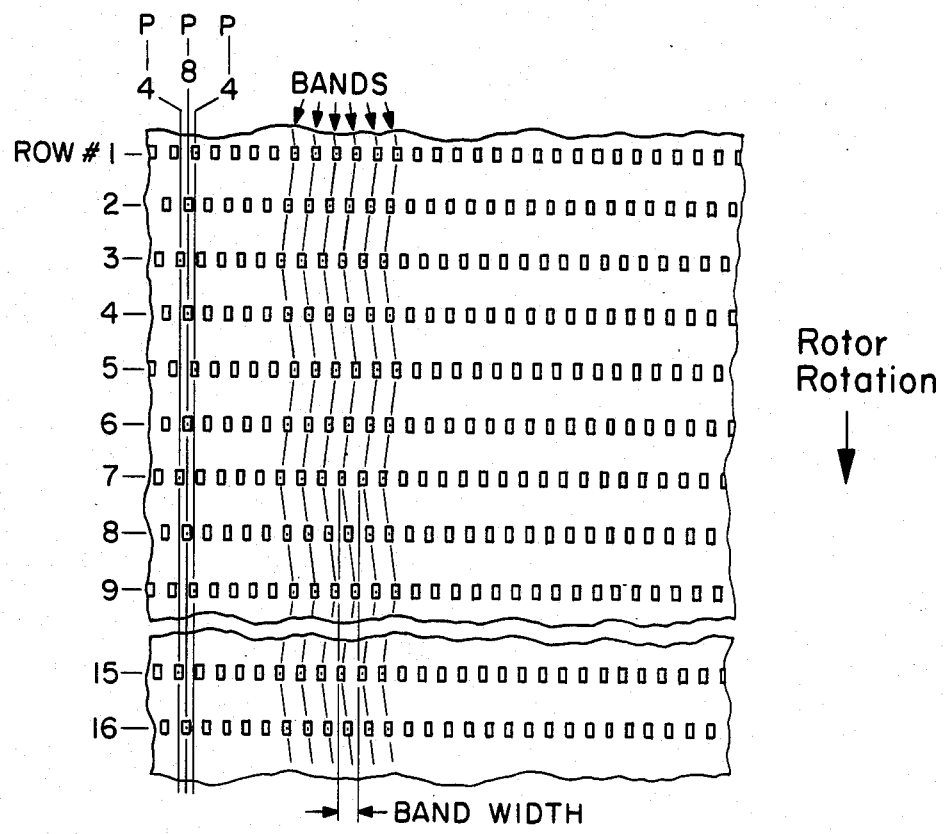
FIG. 5 is a developed fragmentary plan view of the periphery of the fiberizer rotor of FIG. 1 showing a periodic wave pattern of rotor teeth according to this invention.

According to this invention, the teeth 48 are arranged in circumferentially extending bands transverse to the rotor axis, as shown in FIG. 5, in a periodic wave form within each band which provides impacts along a cross direction line adjacent the anvil distributed in simple harmonic motion within each machine direction strip of the sheet corresponding to each band on the rotor.

As a result of the periodic wave pattern, with the rotor 40 driven at a given peripheral speed, the impacts from the teeth impulsively load the leading edge of the sheet and are timed so that the loading is automatically regulated to generate stress waves which cause the sheet to flutter or vibrate within the infeed slot in the section just before the anvil. It is considered that the periodic impulsive loading creates machine direction and cross direction stress waves traveling from the node of impact which, with the resulting vibrations and stretching of the sheet, causes a preconditioning of the sections of the sheets being fed to the anvil before the direct impacts, which smash the edge of the sheet against the anvil, this preconditioning serving to break a portion of the interfiber bonds within the sheet before reaching the anvil. It is also considered that the generated and automatically regulated internal stress waves within the sheet and the preconditioning enhance the "explosion" debonding after rebound of the sheet from the anvil, this post-impact explosion resulting in a higher level of fiberization than conventional fiberizers.

To mount the teeth in this manner, as illustrated in FIGS. 1 and 2, the rotor 40 has slots 52 spaced around its periphery and rows of recesses 54 in which the bases of the teeth 48 are locked in position so that the teeth project radially outwardly. The teeth 48 protrude from the periphery of the rotor and are arranged in spaced MD planes "P", the number of teeth in each plane "P" in FIG. 5 being determined by the desired pattern. In keeping with the invention, the ideal periodic pattern is thought to be a sinusoidal pattern. However, for practical structural reasons, the best known way to achieve the desired pattern is to mount the teeth in triangular wave form, as illustrated in FIG. 5. All periodic patterns are not satisfactory. For example, a square wave pattern would not be satisfactory. Acceptable periodic wave forms include wave forms having no abrupt changes between the peaks. Furthermore, the patterns in adjacent bands or sections of the rotor do not overlap, as shown in FIG. 5. However, it is possible that overlapping wave forms could be used with satisfactory results.

As indicated, the ideal overall pattern for the rotor teeth is believed to be a sinusoidal pattern, which produces impacts distributed in simple harmonic motion along a cross direction line segment corresponding to one band of the rotor periphery. For practical reasons, however, since it is very difficult mechanically to locate teeth precisely in a sinusoidal pattern on the periphery of a rotor, the triangular pattern of FIG. 5 has been chosen as substantial approximation of the ideal pattern. Thus, when the term "simple harmonic motion" is used hereinafter, including in the claims, that term is intended to include motion of substantially that form, such as the distribution of impacts, for example, by teeth located in a triangular pattern as shown in FIG. 5.

It is preferred to have the periodic pattern repeat in the circumferential direction so as to be continuous around the periphery of the rotor within each band, and the same complete pattern is repeated in other bands for the full axial length of the rotor. The stress waves generated in the fibrous sheets by the repeated tooth and anvil impacts are believed to produce harmonic vibrations which are automatically regulated by the periodically repeated impacts.

According to this invention, a preferred pattern, as shown in FIG. 5, includes either an "X" number of teeth or "2X" number of teeth in each MD plane P which form nonoverlapping adjacent periodic patterns extending around the circumference of the rotor, each pattern being within a band of the rotor. The teeth, when in the arrangement illustrated, provide a repeating pattern of 4-8-4 impacts/plane/revolution. Although, the illustrated FIG. 5 pattern is symmetrical, variation from such pattern can produce similar results. It is also to be noted that the teeth are arranged in peripherally spaced rows parallel to the rotor axis. The row hit frequency or time between hits is determined by the rotational speed of the rotor and the peripheral distance between adjacent rows and is set to a value within a range of 0.48 ms to 1.7 ms (i.e., milliseconds between hits), which has been found to allow requisite time for rebounding of the ends of the sheet after being smashed against the anvil and being pulled around the end of the anvil and for relaxation of sheets so preconditioning can occur before the next impulsive load.

Longer intervals between successive row hits has produced a reduction in fiberization levels. With a different rotor speed or rotor diameter, a different repeating pattern may be used, such as 3-6-3 impacts/plane/revolution or 5-10-5 impacts/plane/revolution.

Primary Fiberization

Figure 8:
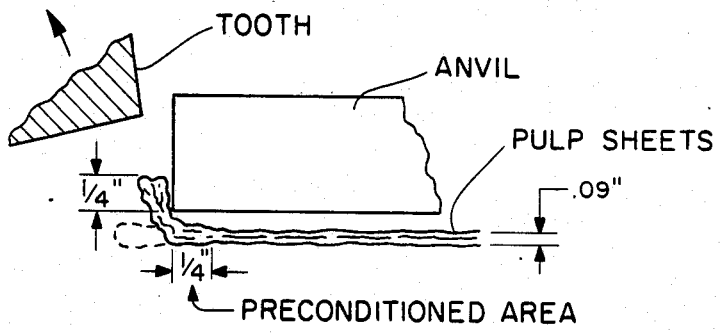
FIG. 8 (PRIOR ART)
FIG. 8 is a schematic view of a fibrous sheet node 0.7 ms (milliseconds) after impact by a tooth based on studies of prior art hammermill operations.

To explain the mechanisms which are believed to cause disintegration of fibrous sheets upon impact, reference should be made to FIG. 8 which illustrates the condition of fibrous sheets in a conventional hammermill immediately after the hammer is clear of the anvil. It will be seen that the end of the fibrous sheet has been pulled around the anvil edge from the direct impact. The end of the sheet then rebounds to the position shown in dotted lines before the next impact. The impact causes a clump of fibers to separate and the node struck by the tooth to swell slightly after impact, as illustrated.

Figure 9:
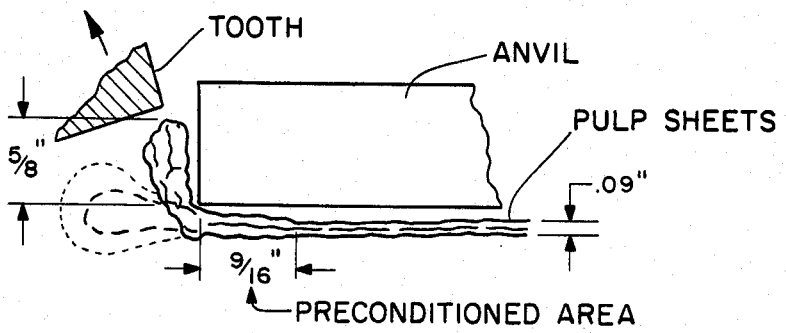
FIG. 9 is a schematic view of a fibrous sheet node 0.7 ms after impact by a rotor tooth in a pattern according to this invention which illustrates the enhanced "explosion" after impact against the anvil.

Now referring to FIG. 9, in accordance with the method of this invention stress waves generated by the periodically repeated teeth and anvil wall impacts cause a highly stressed condition within the sheets and the sections approaching the anvil, evidenced by the sheets fluttering or vibrating within the infeed slot, which can be seen through the aid of high speed motion pictures. Upon impact by a tooth against the anvil, the node rebounds to a radial position, and swells drastically. As indicated in dashed lines in FIG. 9, the end of the sheets explode into a cloud of fibers, which are indicated by the dotted area in FIG. 9. It is believed that the generation of the highly stressed condition within the sheets fractures interfiber bonds in the sections of the sheet being fed to the anvil, called the preconditioned area and the relaxation of the sheet by reduction of the internal stress which occurs after the rebound of the ends of the sheet produces a drastic swelling or expansion of the fibrous node, amounting to an "explosion". This fiber cloud or "explosion" produced at the node is illustrated in dotted lines in FIG. 9. As the next row of teeth impacts the end of the sheet, the fibers at the end of the sheet in both cross directions from the point of impact by each tooth in the row are separated from the sheet by impact. Those fibers in the cloud with most interfiber bonds fractured are more readily then separated from the sheet. Because more fiber bonds are broken when the sheet is impacted by a row of teeth, with the fiberizer of this invention fiberization levels are higher than with a conventional hammermill. It will be appreciated that FIGS. 8 and 9 are highly schematic but are based on observations including motion pictures of the effect at the anvil upon and following impact by the rotor teeth.

When the rotor teeth strike the fibrous sheets, a portion of a node is removed. The node is indicated in the Figures as a dashed area at the end of the sheets. It is generally accepted that, in fiberizing, the largest number of interfiber bonds are broken and individual fibers removed from the direct impact with impacting elements and the anvil wall. However, the present invention attempts to break interfiber bonds by "preconditioning", which is a working of the sheet by traveling waves during the pre-impact period before a section of the sheet reaches the anvil and during the post-impact period. To produce this "preconditioning" and "explosion" requires a particular timing and placement of the teeth impacts.

To draw an analogy, imagine a boy striking an earth clod with a baseball bat. There are many variables that affect the size of the exploded clod particles, e.g., bat velocity, striking angle, the size of the clod. Suppose instead of hitting it, the boy throws the clod against a brick wall. Again, it will break into many pieces if sufficient energy has been transmitted to fracture bonds holding the clod together. If a high speed film were taken of this collision event, it is believed it would show that immediately after impact there is a moment where energy is transmitted through the entire clod before bonds are fractured and the clod begins disintegrating. Instead of a clod, consider a fibrous sheet and a moving hammer or tooth hitting it. At that moment when the sheet's node is struck, most of the node accelerates rather than explodes. The highly accelerated node moves in the same direction as the force due to the impact element striking it. If an anvil is located in the path of the acceleration, the node slams into the anvil. The impact element also pulls the end of the sheet around the anvil, causing a force pulling on and elongating the sheet. At that moment, an impulsive load is transmitted at a rapid rate in the cross direction and through the node and sheet in the machine direction back toward the rollers that feed the sheet. If the impulsive load generated from impact against the anvil and the pulling force is great enough, a preconditioning of the sheet section immediately before the anvil and in the infeed slot will occur, including fracturing of interfiber bonds. Afterwards, the sheet relaxes and the node bounces or rebounds off the anvil back into a radial position ready for the next impact. This occurs because of the sheet's elastic properties and because the node is fixed at one end by the unfiberized portion of the sheet and the infeed rollers. However, if an anvil is not located in the path of the moving end of the sheets, the accelerated sheet will continue to move in the direction of the rotor's rotational movement and, commonly, the sheet will break off in large chunks. In the case where sheets are impulsively loaded by an anvil wall, the amount of energy available to explode the fibrous node will depend on many factors, e.g., the velocity of the accelerated node on impact, the angle that it hits the anvil, the strength and number of bonds holding the fibers together, the number of sheets hitting the anvil, and other factors.

Impulsive Loading:

Upon impact, the action of a suddenly applied load to the end of a sheet is not instantaneously transmitted to all parts of the fiber structure. What does occur follows this sequence:

(1) an almost instantaneous (less than a fraction of a second) increase in load to a high value of stress;

(2) followed by a rapid decrease in load following the abrupt rise of stress;

(3) transfer of the load through the sheet in the form of mechanical disturbances or stress waves, producing vibrations.

These events occur within a fraction of a millisecond. The fiberizing explosion appears to be following the above described impulsive load steps. As shown in FIG. 9, the node collides with the anvil (step 1) and, as shown in dashed and dotted lines, an explosion occurs (step 2). The entire sequence is believed to take approximately 0.6 ms. While the sheet vibration cannot be seen from the Figures, it was clearly seen on film.

In addition, the foremost characteristic feature of fracturing under impulsive loads is that the load will almost always generate a well defined and reproducible pattern. Unlike fracturing fibrous sheets under static loading in which random fracturing of bonds must be treated statistically, under impulsive loading, fracturing of bonds appears to be predictable and consistent.

As depicted in FIG. 9, repeated deformations and stresses that are produced by impulsive loads created when the impact velocity is great enough will move through the sheets in the form of disturbances or waves that travel with a finite velocity. With wave movement, some interfiber bonds are possibly fractured. Estimated wave velocities in fibrous sheet appear to be similar to wave velocities in woven materials which have been measured at several thousand feet per second.

In fibrous sheets, as the short-lived wave travels through the sheets, the relative freedom of the fibers to move will influence the speed and spreading of the waves. The direction in which fibers are oriented relative to the applied impulsive loading force will also influence the type of wave that propagates. It has been observed that energy transmission through sheets differs depending on whether the fibers are oriented in the machine direction (MD) or cross direction (CD) of the sheet relative to the direction of application of either static or impulsive loading (see FIG. 2). It is known that fiberizing in the cross direction to the direction in which the sheet was formed produces higher fiberization levels than fiberizing in the direction that the sheet being fiberized was formed. Because of fiber alignment, when a sudden impulsive force is applied, velocities of MD waves within conventional pulp sheets are estimated to travel about twice as fast as CD waves. Analysis of such sheets has shown that fiber orientation is primarily in the machine direction, which has been demonstrated by measuring MD and CD tensile strength properties and comparing them, with the usual result that the MD tensile strength is about twice the CD tensile strength. The preferred rotor teeth arrangement takes account of this phenomenon in the spacing of the teeth so as ideally to continuously attempt to excite CD oriented fibers.

Mechanical disturbances are transmitted through fibrous sheets by wave propagation resulting from the impulsive loading which occurs by the direct impacts and when the node is struck against the anvil. A sliding action occurs between fibers since they are relatively inelastic and are held together by entanglement and a limited number of so-called "hydrogen bonds" sporadically located at fiber cross-over points.

Vibrational Waves:

To explain how a tooth impact can propagate a wave motion in a fibrous sheet, imagine a narrow portion of the sheet as a string. If the string is fixed at one end and accelerated at the other end periodically, a distinct wave is created traveling through the string in the direction of the fixed end. A tooth in a fiberizer first hitting the free end of a sheet and then smashing it into the anvil wall produces a directionalized force traveling down the sheet and spreading out. If the impact force is repeated with sufficient intensity at a proper time to reinforce a vibration, a vibrational wave will be created and continued as described in the string analogy. If these vibrational waves are such to enhance the rupturing of interfiber bonds, fiberizing of fibrous sheets will be enhanced. Of course the string analogy ends at this point for a pulp sheet acts as a plate, not a string. To envision how waves react in the cross direction imagine a stretched rubber band fixed at both ends and simultaneously excited at both ends. Waves would be seen moving from both ends towards the center, colliding and at this point the amplitude and stress level would be the greatest. Similarly with pulp sheets when a row of teeth hit, teeth spaced adjacent one another would propagate waves in the pulp sheets cross direction at impact.

Figure 6:
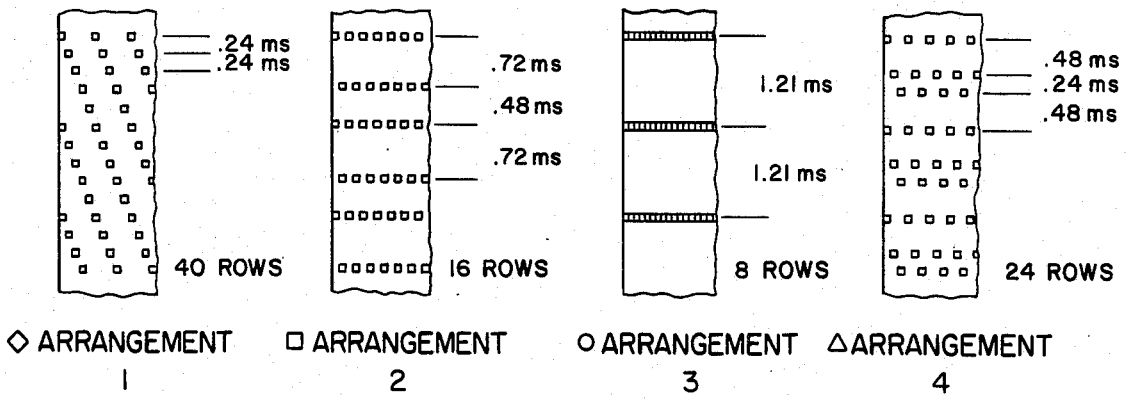
FIG. 6 is a graph of percent fiberization versus throughput for different teeth arrangements, also schematically shown on FIG. 6.
Figure 6:
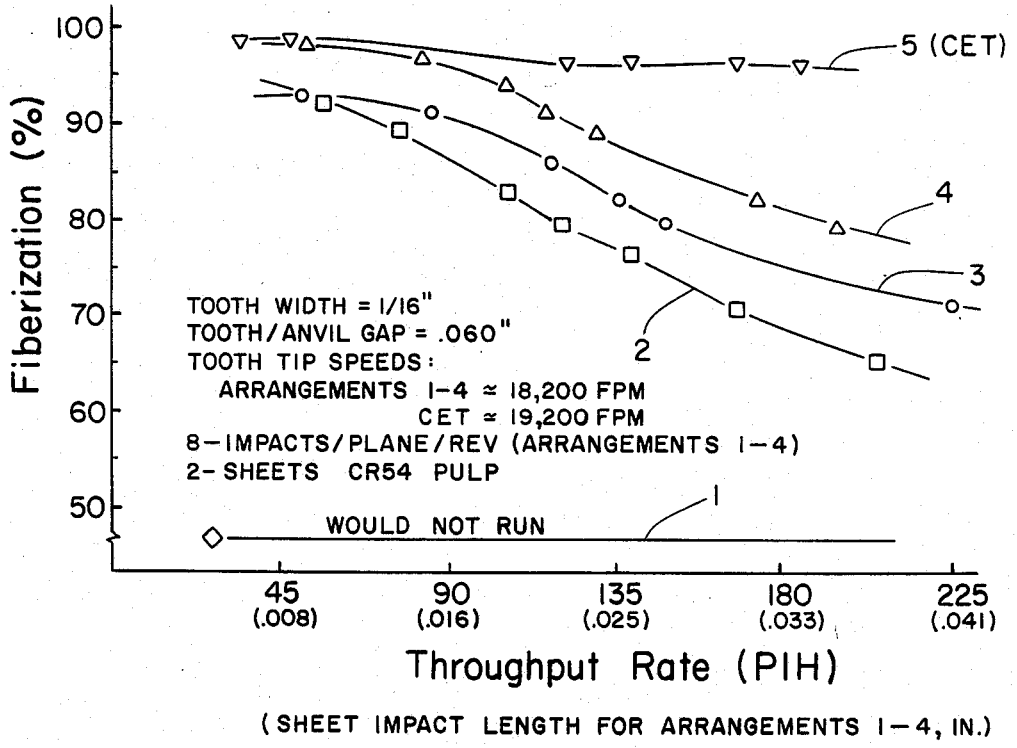
Figure 7:
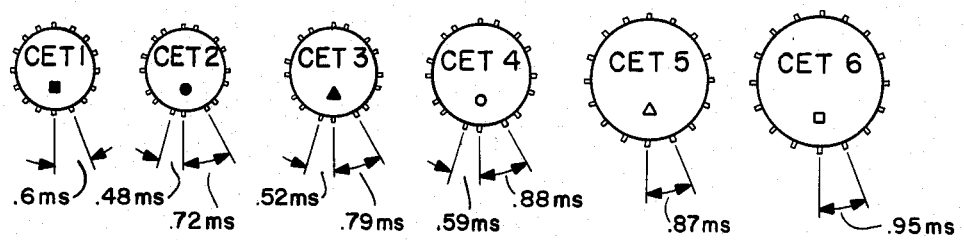
FIG. 7 is a graph of percent fiberization versus throughput for fiberizer rotors having different teeth patterns on the rotor periphery according to the present invention and illustrating the difference in performance according to variations in hit frequency and even and uneven row spacings.
Figure 7:
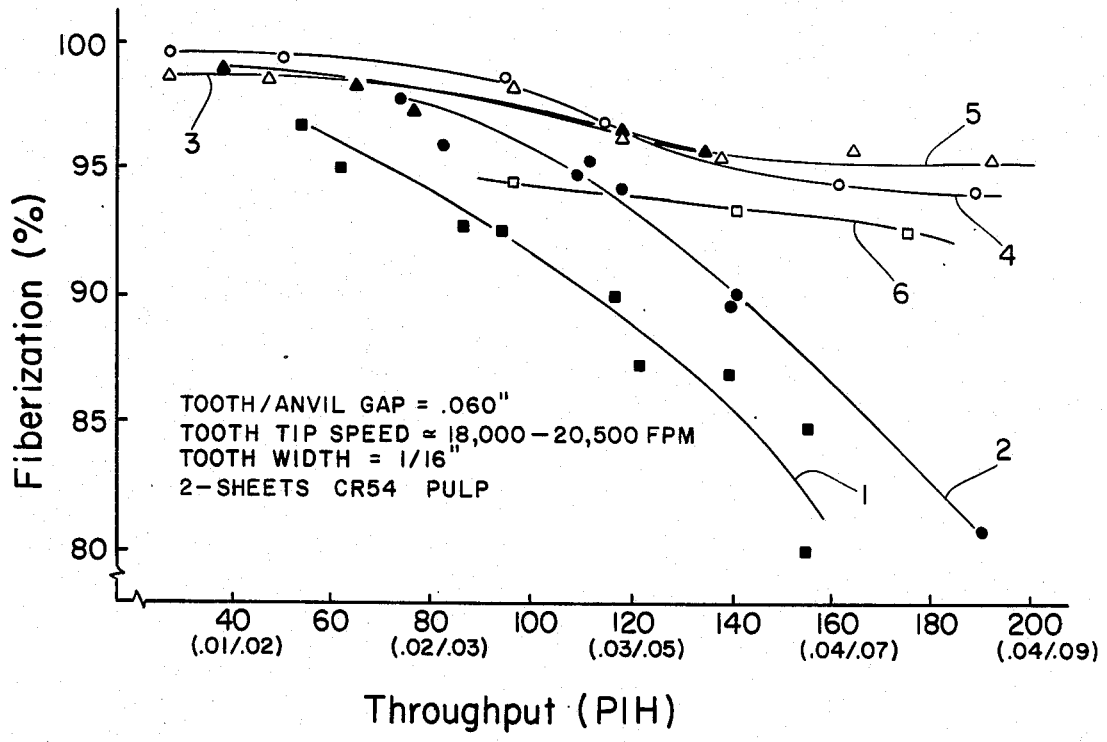

In carrying out this invention, individual points along the width of the fibrous sheet are periodically impulsively loaded when they are at a period of highest response, i.e., when the initial stress level has been increased to the highest optimal stress without causing fiber damage. With this and the fact that typically vibrating waves have motions that are nearly harmonic, it is proposed that the MD and CD waves are traveling in a sinusoidal form. Therefore, as shown in FIG. 5, the rotor teeth are arranged within bands which extend transversely around the rotor axis, and the rotor teeth pattern in each band is circumferentially extending in an approximately sinusoidal wave on the rotor periphery which extends in the direction of rotation and thereby provides oscillating distributions of impacts in the form of simple harmonic motion along a cross direction impact line adjacent the anvil and thus within adjacent strips of the sheet corresponding to the bands create a vibrational node in each strip that propagates vibration waves. By the use of these patterns in fiberizers constructed and operated according to this invention, referring to FIGS. 6 and 7, fiberization levels (measured according to the standard to be described) at an anvil were raised substantially above 70–80 percent levels at 150–200 pounds of pulp per inch of width of the fiberizer per hour (i.e., pih) throughput rates which were obtained with prior arrangements of hammers, represented in FIG. 6 as hammer arrangements #1 to #4. With fiberizers constructed according to this invention, as shown in FIG. 7, 90+ percent fiberization levels at 200 pih were obtained.

According to this invention, energy is transmitted to precondition the sheets as they are fed to the periphery of the rotor. Now envision the impulsive load always occurring in the exploded area of the node. Because of the node's higher bulk and fewer interfiber bonds, higher fiberization can be expected. Since the sheets of fibrous material are continuously being fed into the fiberizer, to fiberize effectively, energy must be transmitted on a regular or nearly continuous basis at the proper time and proper location on the sheet to have the "explosions" occur continuously. This is what is meant by "continuous energy transfer", or CET, which is provided by rotors constructed according to this invention.

The sheets can be considered a matrix of fibers with a predominant machine direction fiber orientation and with interfiber "hydrogen bonds" at contact areas. The concept behind the invention is to use impacts to generate periodic stress waves, i.e., high levels of internal stress which have a period fixed by the frequency of the impacts and which travel outwardly from the points of loading and tend to explode the sheet in the Z direction at the wave front. With loading, interfiber bonds are fractured and fibers slide relative to each other without being fractured as the wave front passes and stress waves are dissipated.

By timing impacts to automatically regulate the periodic stress waves, energy is transferred to the sheets nearly continuously as the rotor rotates.

The stress waves attentuate very rapidly in moving away from the point of impact because the sheet is not a homogeneous, rigid structure, but their effect is believed to be significant both within the immediate strip of the sheet in which the impact is made and within the neighboring strips. In the neighboring strips, the teeth impacts impulsively load the sheets and create waves traveling outwardly from the points of impact. The waves from adjacent strips collide, increasing to a high level the stress within the sheets and aid in producing preconditioning and post-impact fiberization in the zones of collision spaced from the points of impact. In addition, adjacent bands are constantly transversing areas across neighboring strips. Such transversing is believed to keep the sheet in a period of high response. Primary fiberization predominates in the separation of fibers by fiberizers constructed and operated according to this invention, which is highly desired since secondary fiberization often damages fibers.

Parameters Affecting Construction and Operation of CET Rotors

In obtaining the data set forth below and in the drawings, fibrous sheets were used of CR54 roll pulp, which is a commonly available Southern pine kraft chemically nondebonded roll pulp of a typical basis weight of 400 lb/3,000 $ft^2$, 6 percent moisture level, 0.55 g/cc density. It should be noted that the data set forth in FIGS. 10–14 is generated using rotors constructed as known in the prior art and using one anvil in the fiberizer.

Impact Velocity:

Impact velocity is the speed at which an impacting element is traveling when it strikes a sheet. Impact velocities ranging between 11,000 and 30,000 fpm were investigated. Impact velocity, commonly termed tip speed, positively affected fiberization. As the impact velocity increased, fiberization increased.

The effect of impact velocity on fiberization appears to level off at a speed of about 15,000 fpm. It is believed that at velocities less than 15,000 fpm, the fiberizing mechanism is predominantly a tearing action. As tip speed increases, the sheet explosion fiberizing mechanism begins to occur. At a level near 15,000 fpm, sufficient kinetic energy is being impulsively applied to a given area of the sheet to nearly completely fracture all interfiber bonds. With additional energy added at speeds above 15,000 fpm, little additional fiberization occurs. However, it is preferred to use a speed in the range of 20,000–30,000 fpm because of the strong interactions between tip speed and other parameters, including number of teeth, hit frequencies and throughput.

At very high velocities, if the time between hits is less than about 0.7 ms, fiber damage becomes excessive with certain types of fiber, such as CR54 Southern pine kraft pulp, which places a practical upper limit on impact velocities. The time interval between row hits is hereinafter, including in the claims, synonymous with row hit frequency; i.e., 0.7 ms is equivalent to about 1429 hits per second.

Sheet Impact Length:

The amount of sheet surface area that is struck by a tooth is called the sheet impact area. It is determined by the following variables:

(1) tooth tip speed, (2) cross deckle width of a tooth, (3) number of teeth located within the given sheet's machine direction plane, and (4) feed rate of sheet into the fiberizer.

By adjusting the speed that sheet is fed to the fiberizer, the sheet's longitudinal length that is struck by a tooth can be varied. This longitudinal length is called the sheet impact length.

Figure 4:
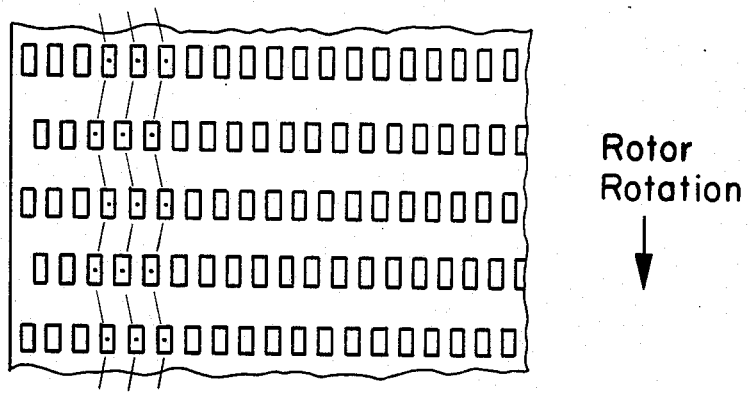
FIG. 4 (PRIOR ART)
FIG. 4 is a fragmentary schematic view of the periphery of a rotor with a further prior art pattern of teeth as described in Sakulich, U.S. Pat. No. 3,519,211.
Figure 10:
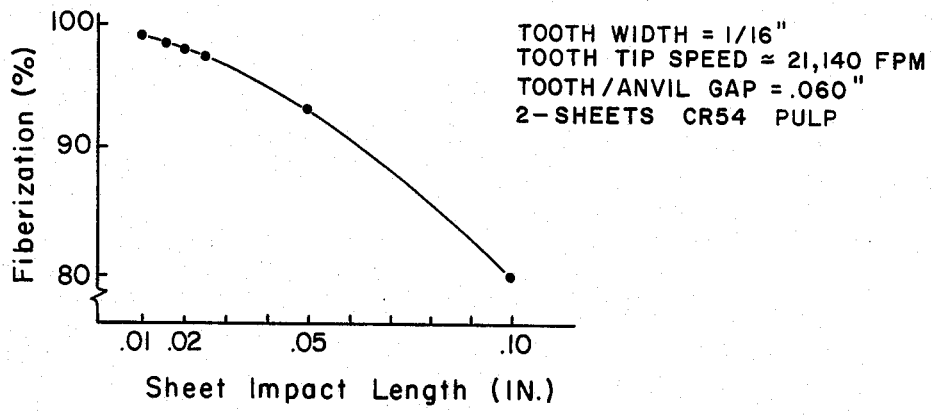
FIG. 10 is a graph of percent fiberization versus sheet impact length.

Referring to FIG. 10, it shows that as the sheet impact length decreases, fiberization increases. When the sheet impact length decreased from 0.1 inches to 0.01 inches, fiberization increased to well above 90 percent. FIG. 10 also shows that for prior art fiberizer illustrated in FIG. 4 the preferred sheet impact length should be no more than about 0.025 inches in order to maintain 95+ percent fiberization levels. Ideally, to design a high fiberizing hammermill with a 0.025 inch impact length as the upper limit, the mathematical relationship between the sheet velocity being fed into a fiberizer and the other variables (1) through (3) must all be considered.

Figure 11:
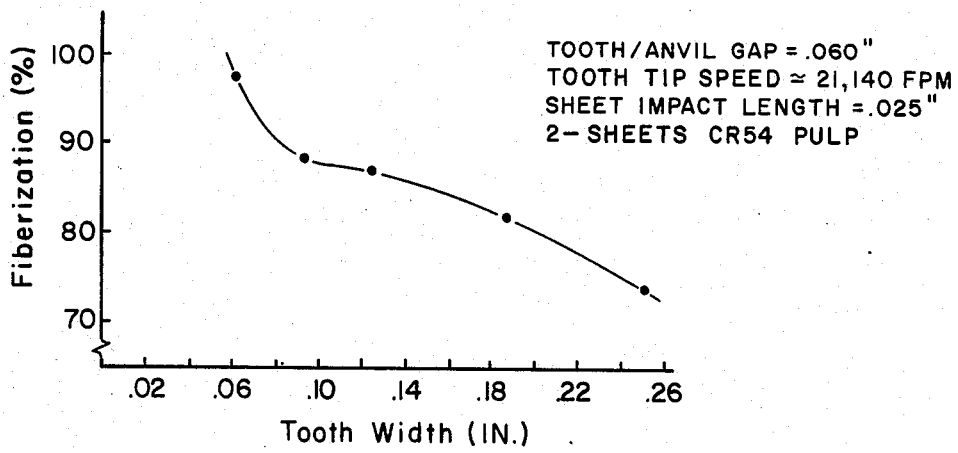
FIG. 11 is a graph of percent fiberization versus teeth width illustrating the effect of impact tooth width on fiberization.

Tooth Width and Sheet Impact Area:

As previously discussed, sheet impact area depends on several variables, including tooth cross deckle width (see FIG. 2). By increasing the tooth width striking a sheet and holding tooth impact velocity, the number of teeth and feed rate constant, the total impact area increases. As the impact area increases, fiberization levels decrease. As shown in FIG. 11, significant fiberization gains were made (using CR54 roll pulp) by narrowing the tooth width from ¼ inch to 1/16 inch. These gains were consistent when sheet impact lengths ranged from 0.025 inch to 0.1 inch. Increasing tooth width was found to negatively effect fiberization. Also, it was observed that narrower tooth widths decreased the process energy efficiency. It is estimated that every 1/32 inch increase in tooth width decreases the number of fibers 100 percent fiberized/hp-hr by about 12 percent. It was also observed that for high fiberization, longer Northern softwood fibers required wider teeth than shorter fibers, such as Southern pine (CR54) or eucalyptus, so that optimal tooth width is dependent on the particular fibers used. It was also observed that for acceptable fiberization levels and low fiber degradation it was preferable to use the wider teeth with the longer Northern softwood fibers.

Figure 12:
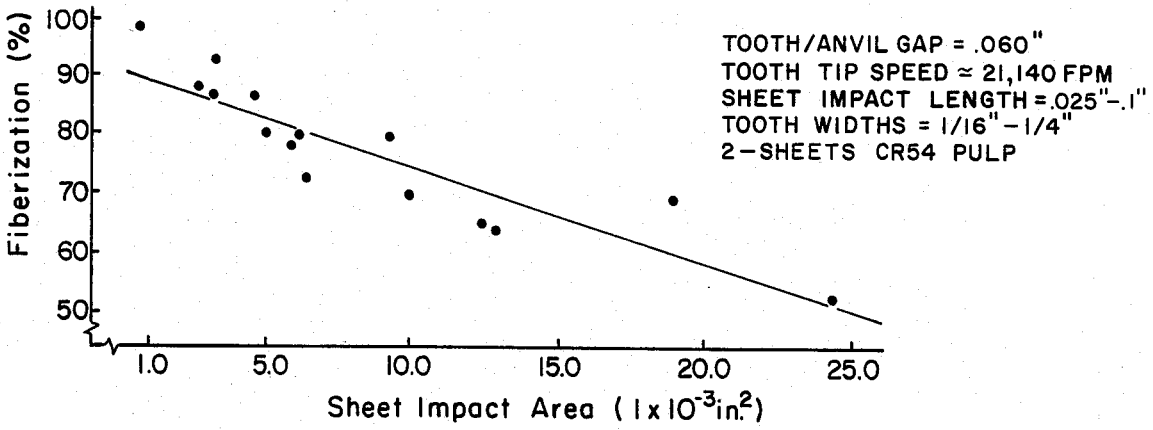
FIG. 12 is a graph of percent fiberization versus sheet impact area struck illustrating the effect of impact tooth area on fiberization.

As shown in FIG. 12, decreasing sheet impact area increases fiberization. To highly fiberize sheets of the commercially available type pulp (CR54) used throughout in obtaining the data described in the Figures, at high throughputs (i.e., 200 pih) it is preferred using prior art fiberizers illustrated in FIG. 4 that the sheet impact area should be no more than $1.62\times10^{-3}$ inch $^2$ i.e., a hammer width of 1/16 inch and sheet impact length equal to or less than 0.025 inch). However, as seen in FIG. 7, with the invention greater than 95 percent fiberization was obtained, at significantly higher sheet impact areas as compared to FIGS. 6 and 10, when hammer widths of about 1/16" were used with sheet impact lengths of 0.09" at 200 PIH in two thirds of the pulp sheet machine direction planes, i.e., $5.62\times10^{-3}$ $inch^2$.

Figure 13:
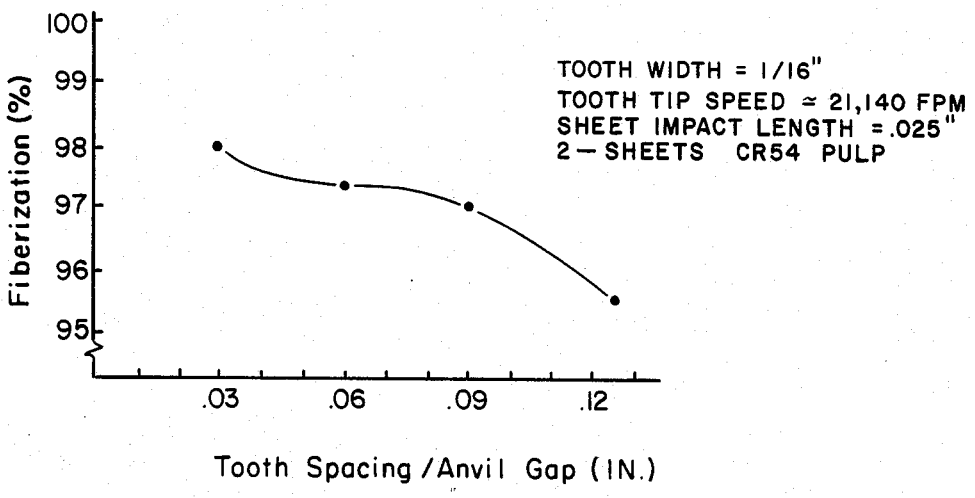
FIG. 13 is a graph of percent fiberization versus distance between the tip of the rotor teeth and anvil illustrating effect of tooth/anvil gap on fiberization.
Figure 14:
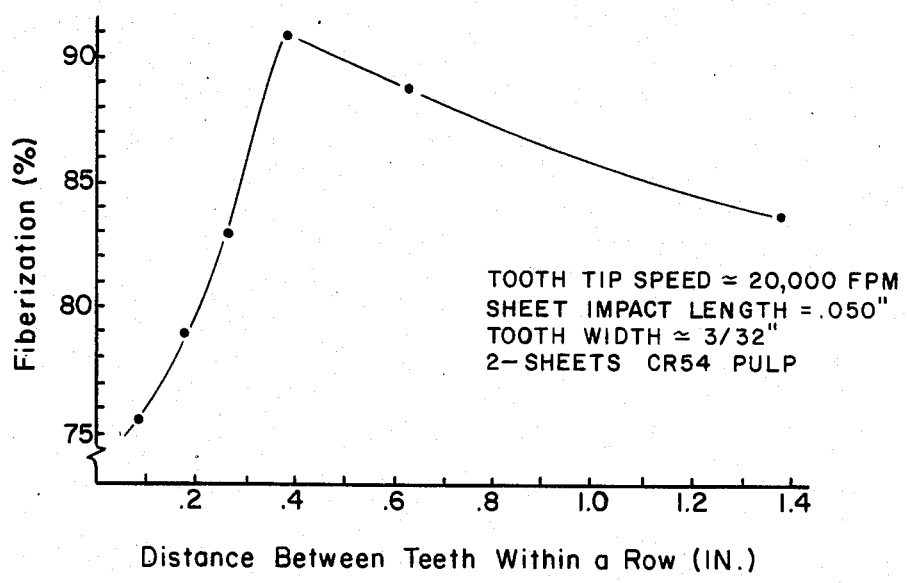
FIG. 14 is a graph of percent fiberization versus distance in a row between rotor teeth.

Tooth To Anvil Gap:

The distance between tooth tips and the anvil face is termed the tooth/anvil gap. As shown in FIG. 13, the gap affects a fiberizer's performance. With the roll pulp tested, it was found that as the gap decreased, fiberization increased. It is preferred that the tooth/anvil gap be in the range of 0.04 inch to 0.12 inch to obtain high fiberization; wider gaps caused fiber damage and poor fiberization and gaps narrower than 0.040 inch caused undesirable "pill" formation and fiber damage. A gap of about 0.060 inch is optimal for two sheets of CR54 but the optimal gap distance is dependent on the number of sheets fed and the particular type of fiber; shorter fibers (e.g., eucalyptus) require narrower gaps and longer fibers (e.g., Northern softwood) require wider gaps for best results.

Anvil Systems:

A preferred construction includes an infeed slot and anvil positioned at an angle that allows the sheet to be fed substantially radially to the rotor teeth. Also preferred is a narrow infeed opening providing sufficient clearance to allow proper vibration but constraining the sheet as it is fed. It has been found that if the opening is too narrow, fiber burning will occur. If the opening is too large excessive sheet movement occurs and fiberization decreases. The opening preferably is between about 0.2" and about 0.38 for two sheets of pulp having a total pulp thickness of about 0.09 inch. The sheet support plates 41 and 43 (see FIG. 1) should extend to a point about flush with the edge of the anvil.

By feeding pulp in two or more anvils simultaneously and reducing sheet feed rates at each anvil, yet retaining the total throughout rate desired, fiberization levels improve because of reduced sheet impact length. This allows higher fiber throughput without sacrificing fiber quality.

Conclusions reached are:

(1) At a given fiber throughput, fiberization levels are increased when two or more anvils are operated simultaneously rather than when one is operated.

(2) When two or more anvils are operated simultaneously, fiberization levels are higher when the anvils are spaced further apart around the rotor periphery compared to when anvils are located close together. The further away from one another the anvils are, the higher the fiberization level.

(3) Fiber damage is not a problem with two and three anvil systems.

Number of Sheets Processed:

For nondebonded continuous fibrous sheets such as CR54 in roll form, it is preferred to have two sheets fed to the rotor at an anvil to obtain high throughput without experiencing excessive fiber damage, which typically occurs in the middle sheets when three and more noticeably four sheet assemblies are fed to the rotor. For debonded sheets, three or more sheets can be fiberized without fiber damage.

Impact Face Angle:

The tooth impact angle is the angle a striking face is beveled or inclined inwardly relative to the rotor periphery. The preferred angle is about 30 degrees, as described in Banks' U.S. Pat. No. 3,637,146, but because of tooth wear, it is preferred to provide a smaller angle initially, for example, about 4 degrees.

Figure 3:
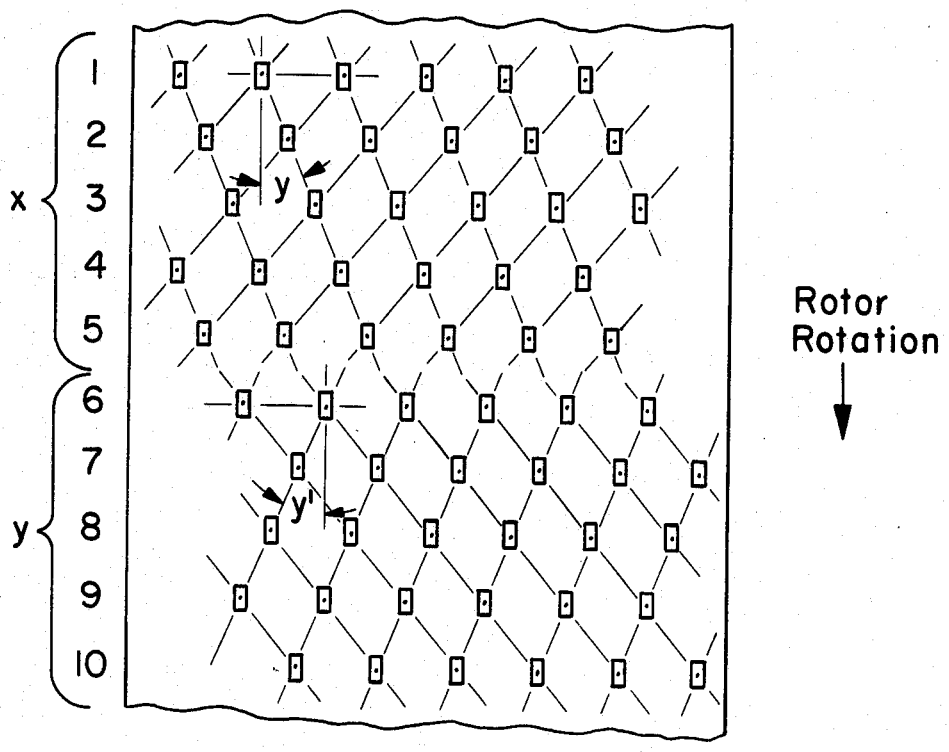
FIG. 3 (PRIOR ART)
FIG. 3 is a fragmentary view of the periphery of a rotor having teeth, in a prior art pattern as disclosed in Buell, U.S. Pat. No. 3,824,652.

Teeth Spacing Within a Row:

Referring to FIG. 2, the distance between teeth in an axial row affects fiberization. Shown in FIG. 14, a distance of around 0.375 inches was optimal using prior art teeth arrangements similar to FIGS. 3 and 4. In the invention the optimal teeth spacing distance, which most likely is affected by preconditioning, is determined by the pulp sheet stiffness or by the most effective distance for waves to collide. With large distances between teeth large areas of sheets may not be preconditioned.

Tooth Arrangements And Hit Frequency:

In the development of the fiberizer of this invention with its characteristic repeating periodic patterns of teeth on the periphery of the rotor, various tooth arrangements were investigated. Referring to FIG. 6, this is a graph of percent fiberization versus throughput for rotors having 1/16" wide teeth with four different tooth arrangements shown in #1 to #4 of FIG. 6 which are not according to this invention, a fifth tooth arrangement (CET) is a tooth arrangement according to this invention and is shown in the graph of FIG. 6. The data for the #1 to #4 rotors and the CET fiberizers of FIGS. 6 and 7 were generated in a single anvil fiberizer.

As shown in FIG. 6, the rotor having arrangement #1 contained forty rows of teeth spaced 0.88 inch apart in the axial direction and 0.235 inch apart in the cross direction. These are arranged in helical patterns similar to the prior art arrangement of FIG. 3. When the rotor was operated at 6,175 rpm (tip speed approximately 18,200 fpm), the row hit frequency was about 0.24 ms. This arrangement would not fiberize fibrous sheets of CR54 pulp. Two sheets would not enter the rotor rotational arc; rather, they would buckle up between the infeed drive nip and anvil infeed port. Several attempts were made to radially feed the sheets by modifying the anvil infeeding system, without improving results. It is believed that the reason why the fiberizer would not "accept" the sheets was that the tooth row spacing was so close that the sheets were "recognizing" a solid rotating "cylinder" rather than a "cylinder" containing distinct teeth or protuberances. With the sheets "recognizing" a solid "cylinder", they were being driven into the "cylinder" and not accelerated against the anvil or cut off as individual fibers and thus jamming the infeed. To use arrangement #1 of FIG. 6 it is believed that a variable speed rotor would be used to regulate the operating rotor speed at different throughput rates.

In arrangements #2–#4, the row hit frequency was reduced by spacing teeth closer together in the cross direction and reducing the number of rows. Significant fiber burning did not occur when fiberizing with arrangements #2 and #3, but there was unacceptable fiber burning with arrangement #4. Arrangement #2 and #4 of FIG. 6 use tooth patterns similar to the prior art arrangement shown in FIG. 4. The fiber burning was observed by visually inspecting the ends of the sheets. From the fiberization versus throughput graph of FIG. 6, and other fiberization studies it appears that:

lower hit frequencies produce higher fiberization levels when tooth spacing within a row is closer together, or, another way of stating it higher hit frequencies produce higher fiberization levels when the tooth spacing within a row is increased (compare arrangement #2 versus #3).

From an examination of the #2 and #4 arrangements depicted in FIG. 6, it can be seen that while in both cases a triangular wave can be traced in parallel bands, the spacing of the teeth in either triangular wave does not vary substantially sinusoidally or follow a harmonic distribution. With teeth arranged in such patterns, they will not provide impacts distributed in simple harmonic motion along the cross direction impact line adjacent the anvil. Accordingly, even though in both arrangements #2 and #4 the teeth conceivably could be said to lie along a triangular wave in each parallel band, the pattern in each band in both cases is clearly different from any pattern according to this invention since the teeth in those cases will not provide impacts distributed substantially sinusoidally, i.e., in simple harmonic motion, along a cross direction impact line.

Preferred Rotor Tooth Arrangement:

Prototype fiberizers have been built and tested to demonstrate the concept underlying this invention.

Referring to FIG. 5, this is a diagrammatic layout of the rotor periphery with a preferred tooth arrangement for a fiberizer according to this invention, although the invention is not restricted to this specific arrangement. FIG. 5 shows either four or eight teeth located in each machine direction impact plane. The rotor teeth are spaced two rotor teeth widths apart. The periodic arrangement of 4/8/4 teeth in spaced machine direction planes P for an approximately 18 inch diameter rotor, which is illustrated in FIG. 5, provides sixteen rows of teeth around the periphery. With a rotor having a diameter providing a row hit frequency of 0.87 ms, as depicted in the rotor labeled CET #5 in FIG. 7, when operated at a peripheral speed of about 19,200 fpm, the results shown in FIG. 6 as curve 5 were obtained. Note that the fiberizing level was maintained above 95 percent for throughput amounts of 200 pih.

Referring to FIG. 6, the curve for this most preferred fiberizer (CET #5) construction is included so that it can be compared with curves for rotors with tooth arrangements #1 to #4 which are not according to this invention. This invention, as exemplified by the CET #5 rotor, provides substantial increases in fiberizing levels for substantially higher throughput levels, particularly above about 100 pih, where all three arrangements #2 to #4 demonstrated a sharp drop-off in percent fiberization.

The critical nature of the row hit frequency can also be shown by referring to the curves illustrated in FIG. 7. With CET rotors of different diameter operated at about 18,000 to 20,500 fpm peripheral speed, different row hit frequencies were tested. With the rotor labeled CET #1 in FIG. 7, which resulted in an even hit frequency of 0.6 ms, the fiberizing percent followed curve #1, which dropped off severely as a function of increased throughput. Even though the rotor of CET #1 embodied the periodic tooth pattern according to this invention, it is believed that because of the short hit frequency, the post-impact "explosion" was not efficiently occurring, probably due to the sheet structure not being sufficiently relaxed before being struck by the next row of teeth.

The rotor labeled CET #2 incorporated rows of teeth of an uneven row hit frequency of 0.48 ms and 0.72 ms; it performed better than the rotor CET #1.

An uneven 0.79/0.52 ms hit frequency in the arrangement of CET #3 was tested. This rotor outperformed CET #1 and CET #2 and produced 90+percent fiberization at 136 pih but could not be tested at higher throughputs for mechanical reasons. However, extrapolating to 200 pih indicates that it would produce highly improved results, i.e., greater than 95 percent fiberization at throughputs of 200 pih. Although these results were encouraging, the highly fiberized airfelt produced with CET #3 still contained some damaged fibers. Therefore, CET #4 with a 0.88/0.59 ms uneven row hit frequency and CET #5 with a 0.87 ms even row hit frequency were tested. Although fiberization levels were about the same for CET #4 and CET #5, CET #4 produced airfelt with slightly damaged fibers while CET #5 did not. From these results, it appears that an even hitting row arrangement with a longer time between row hits is preferred. An even 0.95 ms hit frequency was tested and found to fiberize more poorly than CET #5, which is shown in FIG. 7 as CET #6.

Therefore, from these results a preferred, rotor may have a tooth pattern with a spacing of about 3½ inch of circumference between tooth rows on a rotor of approximately 18 inch diameter and an even 0.8 ms hit frequency at about 22,000 fpm produces unburned fibers and airfelt of the highest quality at high throughput rates on the order of 200 pih.

It is noted that an important feature of the invention is believed to be in the formation of the rotor teeth in sinusoidal wave patterns. In operation of the fiberizer the adjustment of preferred hit frequencies, tooth width and sheet impact areas lead to preferred performance of the fiberizer with sinusoidal tooth patterns. The advantage of the sinusoidal patterns was demonstrated when an 18 inch diameter rotor with tooth rows spaced about 7 inches apart in sinusoidal pattern was operated with a hit frequency of 1.7 ms (0.8 ms being preferred) the fiberization level was still high at about 87 percent at 200 pih. When operated at the preferred about 0.8 ms fiberization was about 95 percent at 200 pih. As shown in FIG. 6, the best previous performance of prior fiberizers was about 80 percent at 200 pih.

It is also to be noted that continuous energy transfer fiberizing according to this invention is much more energy efficient than conventional equipment. Commercially available hammermills operated at what are considered high throughputs and high fiberization (using screens) are converting pulp to make airfelt at the present time at rates of about 10–11 pounds/hp-hour. With continuous energy transfer fiberizing, present results indicate that nondebonded fibrous sheets in the form of roll pulp can be converted to highly fiberized airfelt at the rate of about 30–45 pounds/hp-hour. A significant cost savings per machine can be expected by using continuous energy transfer fiberizing. Also significant is the improved fiber obtained at high throughput. Laboratory tests indicated that absorbent pads of fibers produced with CET fiberizers have greater absorbency, which is attributed to the fibers being less damaged and having a less twisted and contorted shape than fibers produced by conventional high throughput hammermills.

While the repeating periodic patterns on the periphery of the rotor are depicted in phase axially of the rotor in FIG. 5, they need not be in phase and out of phase patterns may be preferable to reduce noise or for mechanical reasons.

It is preferred that the tooth pattern provides a repeating distribution of impacts in simple harmonic motion along a cross direction impact line and for this purpose the tooth pattern must have a substantially equal plural number of teeth within each 90 degree portion of the wave. The pattern shown in FIG. 5 has three equally spaced rows within each 90 degrees. The pattern of the CET #4 rotor of FIG. 7 has three unequally spaced rows for each 90 degrees of the circumference. In other patterns which may be used, such as a 3-6-3 pattern of teeth, there will be two spaced rows in each 90 degrees of the circumference.

The spacing of the rows of teeth may be uneven or even, preferably even, and where the spacing is even (rows the same distance apart) it is preferably within the range of greater than about 0.7 ms and less than about 0.95 ms; where the row spacing is uneven (rows not the same distance apart), see FIG. 7, the shorter spacing would give a hit frequency greater than 0.48 ms and the longer spacing should give a hit frequency in the range between about 0.7 ms to about 0.95 ms to obtain high percentage fiberizing at higher throughputs. The short hit frequencies are suitable for some materials such as eucalyptus and PULPEX TM.

Too high a speed or too short a time between impacts results in too high a frequency of tooth impacts and causes fiber burning or poor performance.

Too long a time between impacts results in too low a frequency to produce the high percentages (over 90 percent) fiberizing at high throughputs of about 200 pih. The results of too low a frequency of impacts is represented by the performance curve in FIG. 6 for arrangement #3, which curve drops below 90 percent at about 100 pih. The effect of too high frequency of impacts is represented by the performance curve for arrangement #4 in FIG. 6, which curve drops below 90 percent at about 140 pih.

Referring to FIG. 7, the critical nature of the row spacing is shown by how the curves for rotors #1 and #2 drop off at higher throughput levels. Ninety percent fiberizing is maintained with uneven row spacings with the #3 rotor (0.52 ms and 0.79 ms) while there is a sharp drop off shown in the curve for the #2 rotor which has row spacings of 0.48 ms and 0.72 ms. It also was found that a 0.6 ms even spacing of rows of teeth produced poor results (#1 rotor) and 0.95 ms even spacing produced poor results. It is also known that optimal spacing requirements vary according to the type of fiber being fiberized.

An example of a fiberizer in accordance with the invention for commercial use would have a rotor about 22 inches in diameter. The rotor would be about 22 inches wide in the axial direction with about 117 bands of teeth and 20 axial rows of teeth. Each band would be composed of 3 circumferential rows of teeth. The spacing between adjacent teeth in the same circumferential row would be about 14" apart in the end rows of each band and about 7" for the middle circumferential rows of each band. Operating speed would be about 3200 to about 4500 rpm to create an interval between hits of about 0.7 ms to about 0.95 ms in each band. Capacity would be about about 4300 lbs of pulp per hr with 1 or 2 inlets feeding 2 pulp sheets into each inlet. The rate of pulp sheet feed would be up to 150 ft. per minute and the gap between tooth ends and an anvil would be about 0.06 inches to about 0.09 inches for Southern pine CR54 pulp. The divellicated fibers would have a fiberization of greater than 90%. Tooth width of about 1/16" with axial spacing of ⅛ inch space between teeth in the same axial row would be utilized.

Percent Fiberization Test Procedure:

Equipment

The test instrument is a canister with a 12×12 mesh screen dividing the canister into a vacuum chamber which is closed by a lid and a second chamber connected to a source of vacuum. The mesh screen has a 0.028" wire diameter, 43.6% open area and a 0.055" opening width. A timer is provided.

Procedure:

1. Clean screen and inside of vacuum chamber.
2. Weight out 10.0+0.1 gram of fluff (airfelt) to be tested.
3. Break the fluff into approximately 1 inch square pieces and place it loosely in the vacuum chamber. Close lid.
4. With the timer set for 4½ minutes, push the start button. Look at the vacuum gauge to make sure it is at 8.0 inches of water. If not, adjust to get the 8.0 inches of water.
5. After the test has run for 4½ minutes, shut the vacuum, remove all the fluff remaining in the vacuum chamber and weigh to the nearest 0.1 gram.
6. Multiply the weight of the remaining fluff by 10 and subtract from 100. Report this difference as percent fiberization.

The mesh of the screen is designed to allow separate fibers to pass through the screen and to retain fibers that are not fully separated. Theoretically, with 100 percent fiberization, all fibers would pass through the screen. With a remaining amount of fiber in the vacuum chamber of 0.1 gram, the test would report 99 percent fiberization.

We claim:

1. A fiberizer for disintegrating fibrous sheets comprising:

a cylindrical rotor rotatable about its axis;

a casing for said rotor having an infeed slot for feeding a sheet edge first to an anvil adjacent the periphery of said rotor; and teeth on the periphery of said rotor having faces positioned to pass said anvil with a defined gap and impact the sheet fed through the infeed slot along an impact line extending in the cross direction of the sheet adjacent the anvil;

said teeth being arranged in a pattern within each of multiple parallel, now overlapping, circumferential bands transverse to the rotor axis, the pattern of said teeth in each of said bands including "X" number of teeth and "2X" number of teeth, the pattern in each band providing impacts distributed in simple harmonic motion along said cross direction impact line for the transfer of energy to the sheet for fracturing interfiber bonds and separating the fibrous sheets into individual fibers.

2. A fiberizer according to claim 1 in which each of said bands has a width of at least three teeth, the teeth having a width of between about 1/16 inch to about 3/16 inch.

3. A fiberizer according to claim 1 in which each of said bands has a width of at least three teeth, the teeth having a width of about 1/16 inch.

4. A fiberizer according to claim 1, said teeth being arranged in circumferentially spaced rows around the periphery of the rotor aligned parallel with the rotor axis.

5. A fiberizer according to claim 4 in which said rows are unevenly spaced to provide an uneven row hit frequency with the short spacing less than 0.6 ms and the longer spacing greater than 0.7 ms.

6. A fiberizer according to claim 1 in which said teeth in said multiple bands are arranged in circumferentially spaced rows aligned parallel to the rotor axis, and said rows are spaced to provide a row hit frequency between about 0.48 ms and about 1.7 ms.

7. A fiberizer according to claim 6 in which said teeth are between about 1/16 inch and about 3/16 in width and are spaced in said rows in the axial direction of the rotor about the distance of the width of two or three of said teeth.

8. A fiberizer according to claim 6 in which said teeth have a width of between about 1/16 inch and about 3/16 inch.

9. A fiberizer according to claim 6 in which said rows are evenly spaced to provide a row hit frequency between about 0.6 ms and about 1.7 ms.

10. A fiberizer according to claim 6 in which said rows are unevenly spaced to provide an uneven row hit frequency with the short spacing less than 0.6 ms and the longer spacing greater than 0.7 ms.

11. A fiberizer according to claim 1 in which said teeth in said multiple bands are arranged in circumferentially-spaced rows aligned parallel to the rotor axis, and said rows are spaced to provide a row hit frequency of about 0.8 ms.

12. A fiberizer according to claim 1 in which said casing has a plurality of infeed slots at spaced locations around the periphery of the rotor.

13. A fiberizer according to claim 1 in which said infeed slot has a transverse dimension greater than the thickness of two sheets, allowing two sheets to be fed to the rotor together, and the clearance of the slot allowing the sheets to vibrate from energy received from the impacts of the teeth.

14. The fiberizer of claim 1 wherein said rotor has a diameter of about 22 inches, said bands are 3 teeth wide, said teeth have a width of about 1/16 inch, the row of teeth in the middle of each of said bands has twice as many teeth as the outer rows, spacing of teeth within each row is about equidistant apart and the axial spacing between teeth is about ⅛ inch.

15. A fiberizer according to claim 1, the pattern of said teeth on each band being a repeating triangular wave.

16. A fiberizer according to claim 15 in which each tooth is between about 1/16 inch and 3/16 inch in width.

17. A fiberizer according to claim 1 in which each band is between about 3/16 and about ⅜ in width.

18. A fiberizer for disintegrating fibrous sheets into individual fibers comprising:

a cylindrical rotor rotatable about its axis;

a casing for said rotor having an infeed slot for receiving a sheet fed edge-first in the machine direction of the sheet to an anvil adjacent the periphery of said rotor; and teeth mounted on the periphery of said rotor having faces positioned to hit the sheet along an impact line adjacent the anvil and extending in the cross direction relative to sheet fed through the infeed slot;

the teeth being arranged in multiple, parallel, not overlapping, bands extending around the periphery of and transverse to the axis of the rotor;

the teeth being arranged in rows parallel to the rotor axis spaced around the rotor periphery, the spacing providing a row hit frequency between about 0.48 to 1.7 ms;

the teeth within a band being arranged exclusively in a repeating, substantially sinusoidal wave pattern which extends completely around the rotor periphery, the pattern of said teeth includes "X" number of teeth and "2X" number of teeth in the bands of teeth forming said repeating sinusoidal pattern;

the width of each band being about ⅜ inch and each tooth being about 1/16 inch wide; and the individual teeth hits being distributed in simple harmonic motion along said cross direction impact line in each machine direction strip of the sheet corresponding to each band.

19. A fiberizer according to claim 18 in which the sheet being fed at a speed to provide a sheet impact length of between about 0.01 and 0.09 inches projecting from the anvil as each successive row of teeth hits the sheet along said cross direction impact line.

20. A method of fiberizing a fibrous sheet using a fiberizetr having an anvil and a rotor, teeth on the periphery of the rotor having faces positioned to hit the edge of a sheet at the anvil along an impact line adjacent the anvil along an impact line adjacent the anvil and extending the cross direction relative to a sheet fed to the anvil, said teeth being arranged in parallel, not overlapping, bands to provide impacts along a cross direction line adjacent the anvil distributed in simple harmonic motion within each machine direction strip of the sheet corresponding to each band on the rotor and wherein each of said bands includes "x" number of teeth and "2x" number of interior teeth, said method comprising the steps: continuously feeding a fibrous sheet edge—first to said anvil; and impacting the forward edge of the sheet by rotating the rotor so that the impacts at the periphery of each band are "x" and the impacts of interior teeth are "2x".

21. A method according to claim 20 in which the teeth are between about 1/16 inch to about 3/16 inch in width and the sheet impact length at each successive hit is between about 0.01 and 0.09 inch.

22. A method according claim 21 in which the impact area is between about $6.25\times10^{-4}$ to about $5.62\times10^{-3}$ square inches.

23. A method according to claim 20 in which the bands are between about 3/16 and ⅜ inch in width.

24. A method according to claim 23 in which the time between successive teeth impacts is between 0.48 ms and 1.7 ms.

25. A method according to claim 20 in which the time between successive teeth impacts is between 0.48 ms and 1.7 ms.

26. A method of fiberizing continuous roll pulp in an apparatus including an anvil and a rotor, said rotor having rows of teeth arranged in periodic parallel, not overlapping bands so as to obtain impacts distributed in simple harmonic motion along adjacent segments of a cross direction line adjacent the anvil to continuously transfer energy to the sheet for fracturing interfiber bonds and separating the sheet into individual fibers, wherein the patterns of teeth in each band includes "X" number of teeth and "2X" number of interior teeth, said method comprising the steps:

continuously feeding a sheet of said roll pulp to said anvil; impacting the forward edge of the sheet with a row of said teeth to smash it against the anvil; and repeating the impacting with successive rows of said teeth so that the impacts at the periphery of each band are "X" and the impacts of interior teeth are "2x".

27. A method according to claim 26 in which the impacts create mechanical disturbances in the pulp sheet, preconditioning portions of the sheet before reaching the anvil, and causing explosions at the anvil after each impact.

28. A method according to claim 26 in which the impacts are spaced in time and location for creating mechanical disturbances causing harmonic vibrations of the sheet as it is fed to the anvil and continuous transfer of replenishing energy to the sheet for automatic regulation of the harmonic vibrations.

29. A method according to claim 26 in which the sheet is supported with clearance with its opposite surface within a passage as it is fed continuously to the anvil, the clearance allowing the sheet to vibrate within the passage, causing interfiber bonds to be broken to precondition the sheet as it is fed to the anvil.

* * * * *